US005702271A

United States Patent [19]

Steinman

[11] Patent Number: 5,702,271

[45] Date of Patent: Dec. 30, 1997

[54] ULTRA LOW PROFILE BOARD-MOUNTED MODULAR JACK

[75] Inventor: Joseph Richard Steinman, Flower Mound, Tex.

[73] Assignee: The Whitaker Corporation, Wilmington, Del.

[21] Appl. No.: 697,798

[22] Filed: Aug. 30, 1996

[51] Int. Cl.[6] ..... H01R 23/02

[52] U.S. Cl. ..... 439/676; 439/607; 439/79

[58] Field of Search ..... 439/676, 607, 439/67, 79, 609, 610

[56] References Cited

U.S. PATENT DOCUMENTS

| | | | |
|---|---|---|---|
| 3,860,316 | 1/1975 | Hardesty | 339/91 R |
| 4,221,458 | 9/1980 | Hughes et al. | 339/126 R |
| 4,457,570 | 7/1984 | Bogese, II | 339/17 C |
| 4,457,575 | 7/1984 | Davis et al. | 339/143 R |
| 4,497,526 | 2/1985 | Myers | 439/676 |
| 4,647,136 | 3/1987 | Kinoshita et al. | 439/676 |
| 4,698,025 | 10/1987 | Silbernagel et al. | 439/79 |
| 4,744,769 | 5/1988 | Grabbe et al. | 439/284 |
| 4,781,626 | 11/1988 | Lazarchik | 439/680 |
| 4,838,811 | 6/1989 | Nakamura et al. | 439/610 |
| 4,952,170 | 8/1990 | Pritulsky | 439/509 |
| 5,041,017 | 8/1991 | Nakazato et al. | 439/509 |
| 5,346,405 | 9/1994 | Mosser, III et al. | 439/188 |

OTHER PUBLICATIONS

"FCC Rules for Registration of Telephone Equipment, Part 68, Subpart F, Connectors", pp. F-1 to F-14; (Aug. 1993); Federal Communications Commission, complied by Registration Rules Service, Inc., Columbia MD.

*Proposed IEEE P1386/Draft 2.0 of Apr. 4, 1995*,"Draft Standard for a Common Mezzanine Card Family: CMC"; pp. i-iv, 1-6, 11-14,23,25,47; (Apr. 1995); The Institute of Electrical and Electronics Engineers, In., New York, NY.

U.S. Patent Application Ser. No. 08/656,108 filed May 31., 1996 (Abstract and Drawings only included).

*Primary Examiner*—Gary F. Paumen
*Assistant Examiner*—Tho Dac Ta
*Attorney, Agent, or Firm*—Anton P. Ness

[57] ABSTRACT

A modular jack (10) mountable to a circuit board (12), with a bottom section (50) of a housing (32) forwardly of solder tails (38) of contacts (36) thereof, being disposed within a recess (52) in the circuit board, whereby the height of the top surface of the jack above the circuit board is minimized without reducing the size of the plug-receiving cavity (30) of the jack.

6 Claims, 6 Drawing Sheets

ULTRA LOW PROFILE BOARD-MOUNTED MODULAR JACK

FIELD OF THE INVENTION

This relates to the field of electrical connectors and more particularly to circuit board mountable connectors.

BACKGROUND OF THE INVENTION

Modular jack connectors are prevalently in use in the telecommunications industry, matable to modular plug connectors commonly terminated to multi-conductor cable for signal transmission. One example of such a modular jack is disclosed in U.S. Pat. No. 4,221,458 in which an insulative housing defines a plug-receiving cavity extending inwardly from a mating face, in which are disposed spring arms of discrete contact members extending at an angle into the cavity from a side wall to be engaged and deflected by corresponding contacts of a plug connector during mating to establish the electrical connections therebetween. The plug connector utilizes an elongate latch arm that extends from the plug mating face rearwardly to define a manually deflectable tab for delatching when desired; the latch arm extends outwardly from the mating face of the jack when the connectors are mated, for the tab to be accessible, and the jack's plug-receiving cavity includes a recess along a side wall forwardly of the complementary latching surface of the jack as a clearance for the latch arm.

Modular jacks may be mounted onto a circuit board within an electronic apparatus such as a computer, at an input/output port having a cutout for insertion of the plug connector thereinto to become mated with the modular jack. The modular jack may also include a surrounding shield member for protection against electromagnetic and radiofrequency interference (EMI/RFI), such as is disclosed in U.S. patent application Ser. No. 08/656,108 filed May 31, 1996 and assigned to the assignee hereof.

It is desired to provide a receptacle or jack connector that defines a low profile extending above the circuit board on which it is mounted.

SUMMARY OF THE INVENTION

The present invention provides a connector mountable onto a circuit board at an edge thereof in a manner such that the top most surface of the connector is a minimized height above the circuit board.

A portion of the connector is seated within a recess of the board extending inwardly from an edge of the board. While a shield member includes a bottom wall extending continuously across the bottom of the connector, the housing does not provide a continuous bottom wall. Instead, where the connector is a modular jack, the recess defining the clearance for the latch arm of the plug connector to be matable with the receptacle extends through the bottom wall of the housing. Bottom wall sections of the housing that define side walls of the latch arm recess, are disposed in the circuit board recess and include rearwardly facing surfaces that provide the latching surface.

The spring arm contact sections extend into the plug receiving cavity from the top wall, with rear sections that extend rearwardly from the housing and include right angles to extend downwardly for receipt into through holes of the circuit board rearwardly of the housing and the circuit board recess; optionally the rear sections could include horizontal end portions for surface mounting, if desired.

An embodiment of the invention will now be described by way of example with reference to the accompanying drawings.

DETAILED DESCRIPTION

Figure 1:
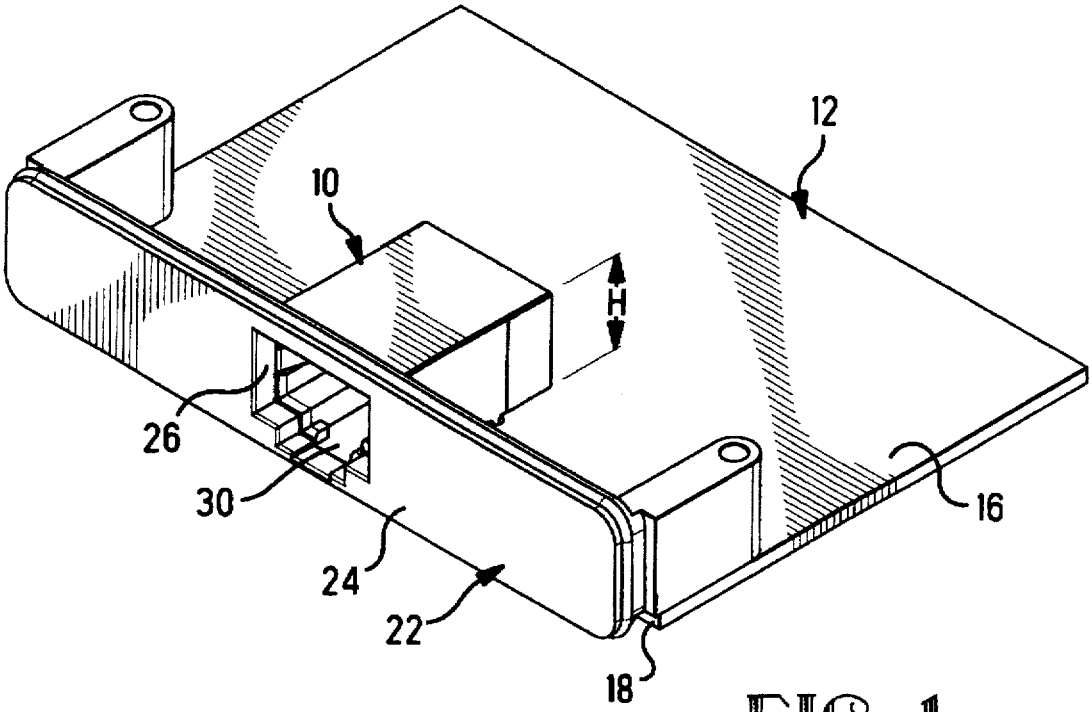
FIGS. 1 and 2 are isometric views of the jack and circuit board of the present invention as assembled with a frame member, and exploded.
Figure 3:
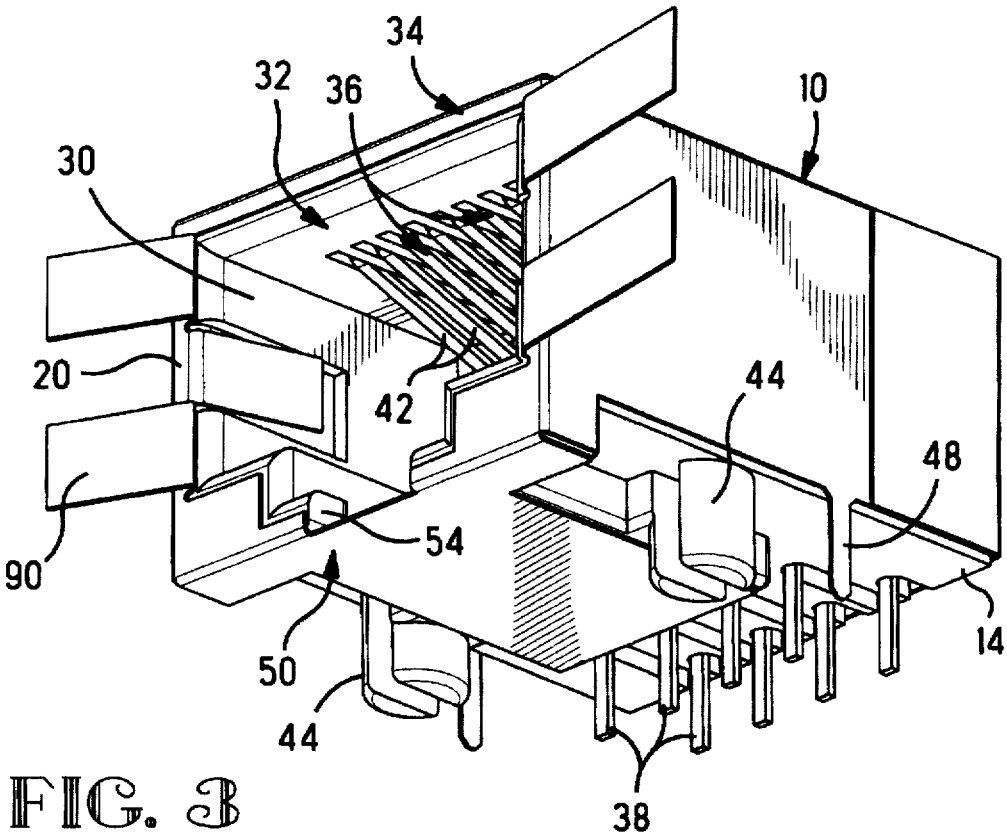
FIG. 3 is an isometric view of the jack of FIGS. 1 and 2 from below and forwardly thereof.
Figure 2:
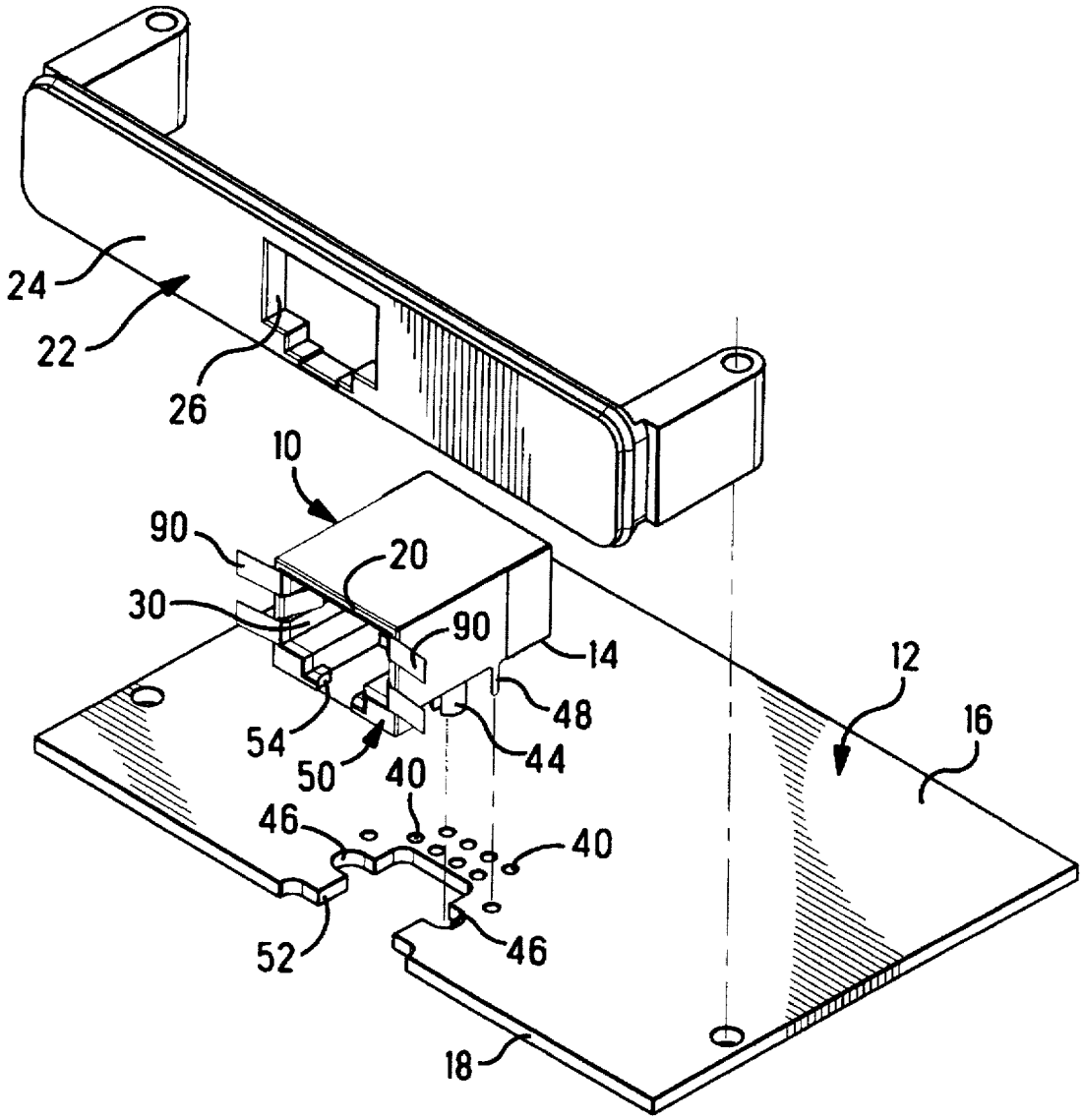
Figure 4:
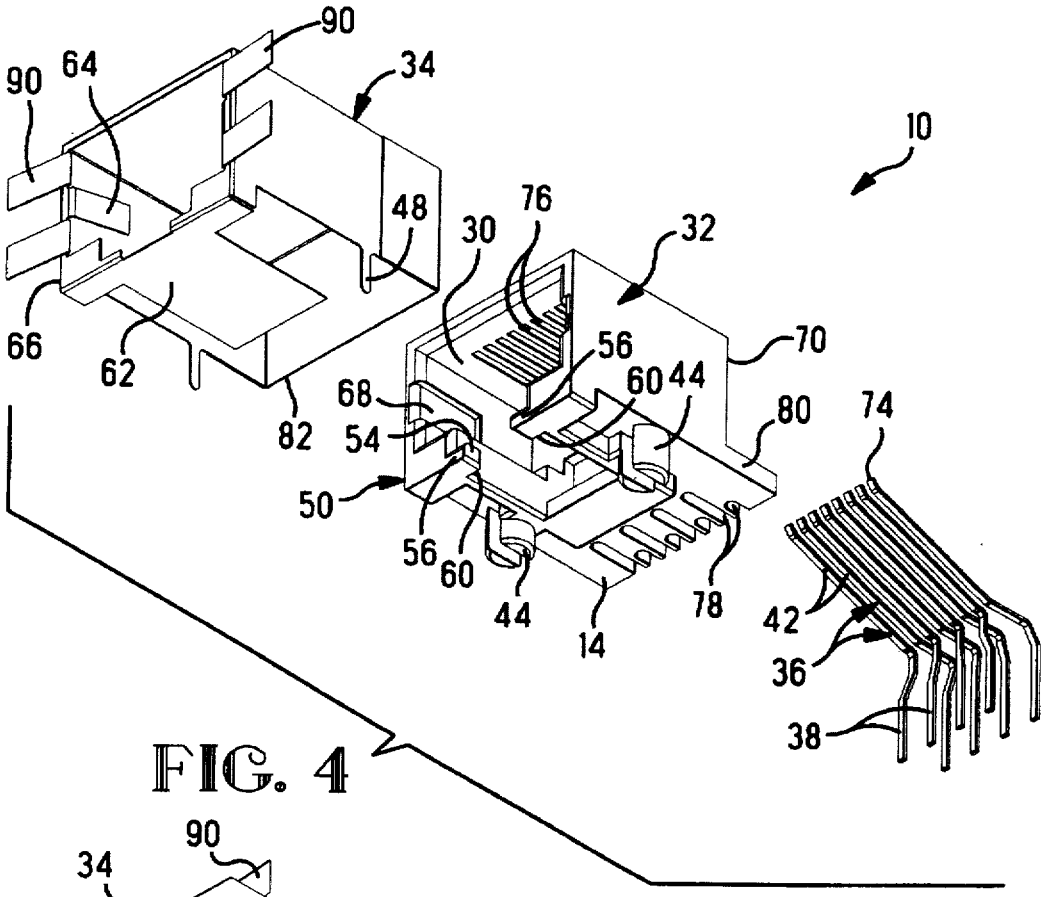
FIGS. 4 and 5 are isometric exploded views of the jack of FIGS. 1 to 3 from below forwardly and above rearwardly, respectively.
Figure 5:
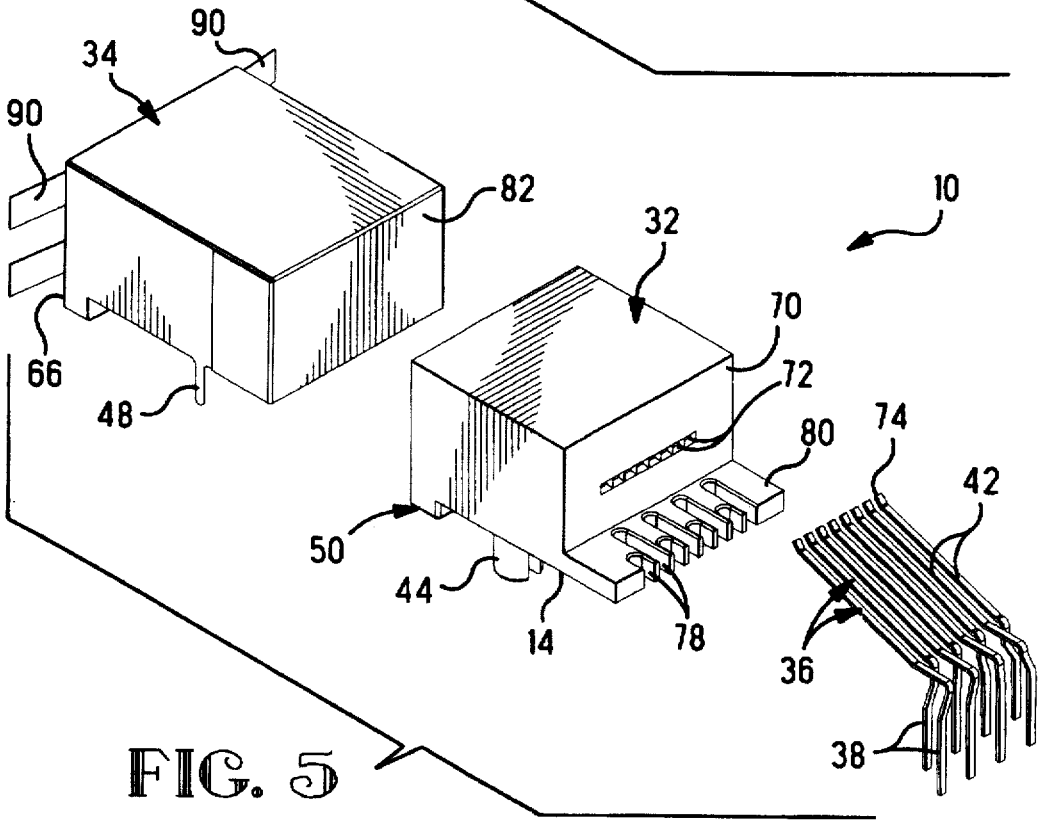
Figure 6:
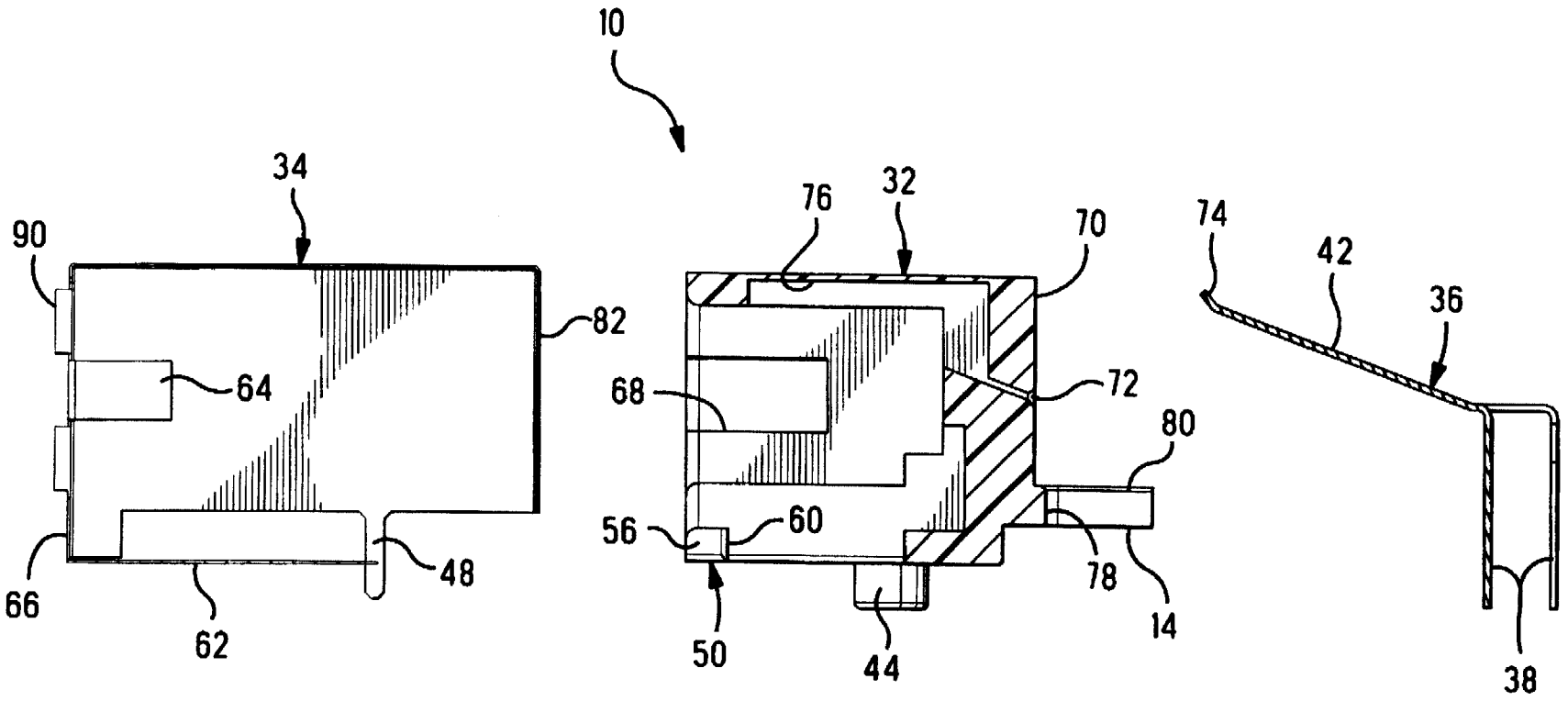
FIGS. 6 and 7 are an elevation cross-section of the jack exploded and assembled, respectively.
Figure 7:
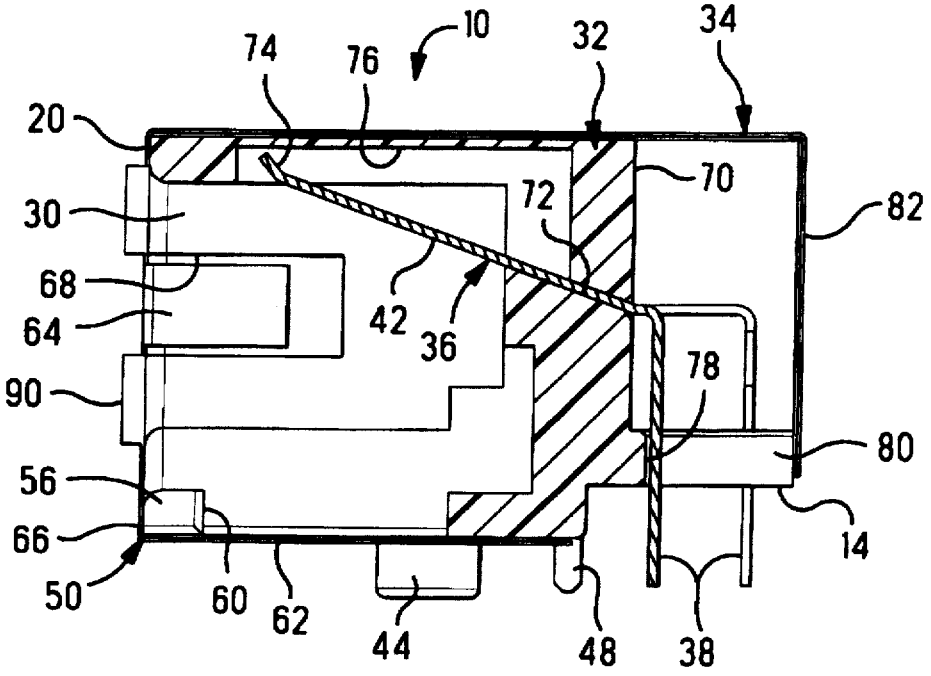

Referring first to FIGS. 1 to 3, a connector such as modular jack connector 10 is mountable onto a circuit board 12 and includes a board mounting face 14 along the bottom thereof associated with the top surface 16 of the circuit board. Connector 10 is mountable along edge 18 of the circuit board and includes a mating face 20 thereat such that the board and connector may be mounted within an electronic apparatus such as a computer, at a panel cutout defining an input/output port of the apparatus. If desired, a conductive frame member 22 may be secured along board edge 18 and including a transverse plate section 24 forwardly of mating face 20 for being seated within a larger panel cutout (not shown) and including an opening 26 aligned with the plug-receiving cavity 30 of the jack extending inwardly from mating face 20.

Jack 10 includes an insulative housing 32 surrounded by a shield 34, and a plurality of contacts 36 are mounted in the connector having solder tails 38 depending from board mounting face 14 for insertion into through-holes 40 of circuit board 12 and soldering therewithin. Contacts 36 also include spring arm contact sections 42 extending into plug-receiving cavity 30 to become engaged by and mated with complementary contacts of a plug connector (not shown). Housing 32 also is shown to include board-mounting legs 44 depending from board mounting face 14 to retain the connector to the board, having resilient legs for mounting within mounting recesses 46 of board 14 and precisely positioning the array of solder tails 38 with respect to through-holes 40 and relieving stress from the solder terminations thereof. Shield 34 includes ground contacts 48 depending from board-mounting face 14 to form ground connections with ground circuits of board 12.

Figure 8:
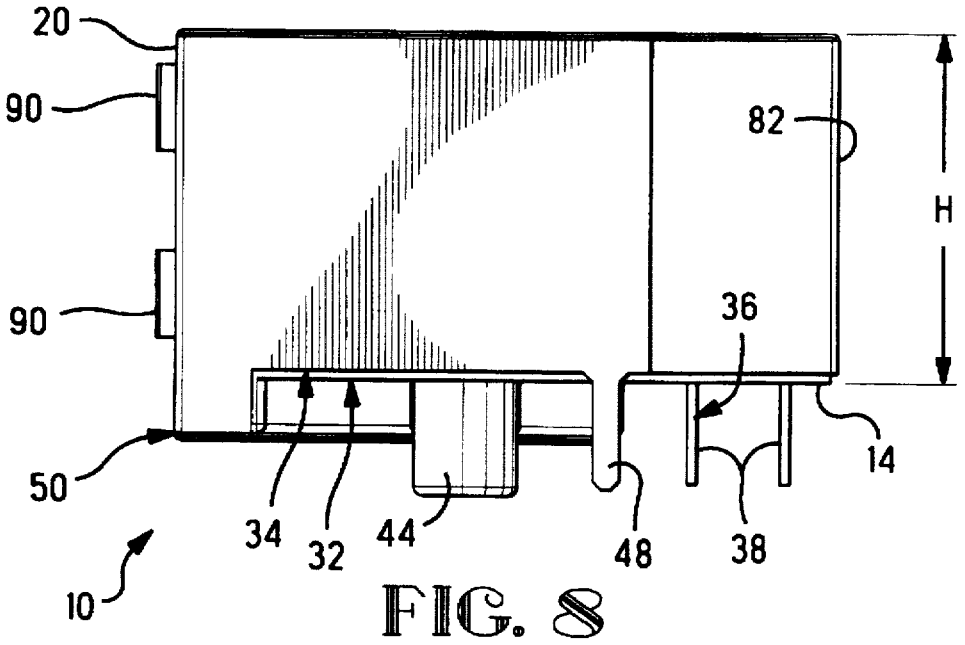
FIGS. 8 to 10 are an elevation side, front and bottom view of the jack of FIGS. 1 to 7.
Figure 9:
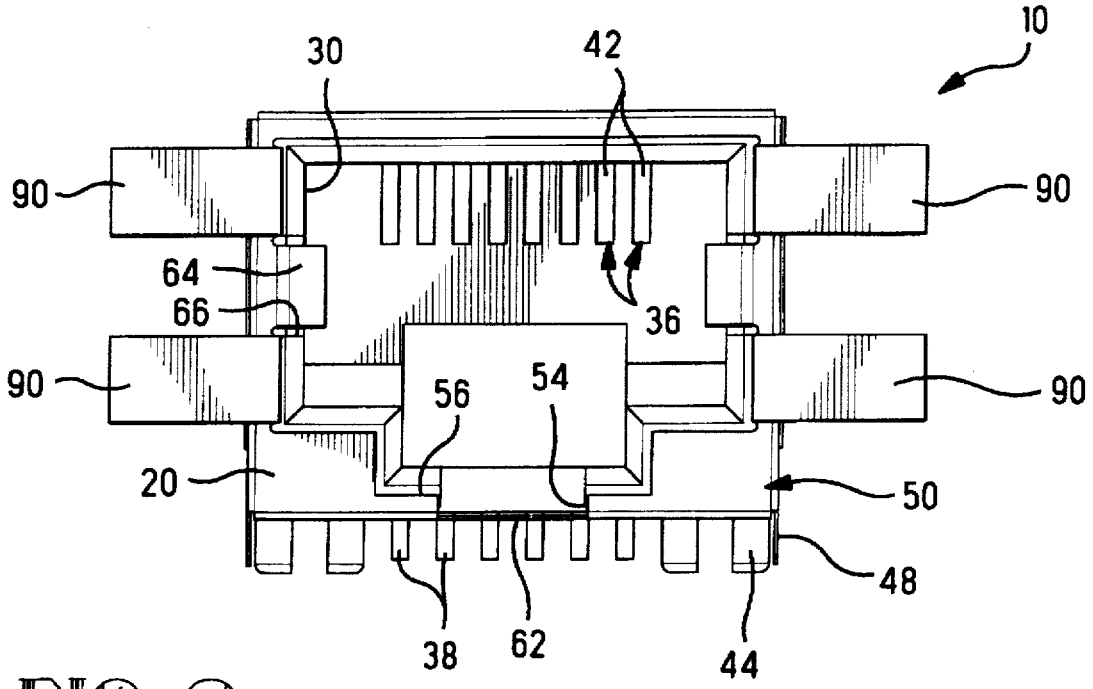
Figure 10:
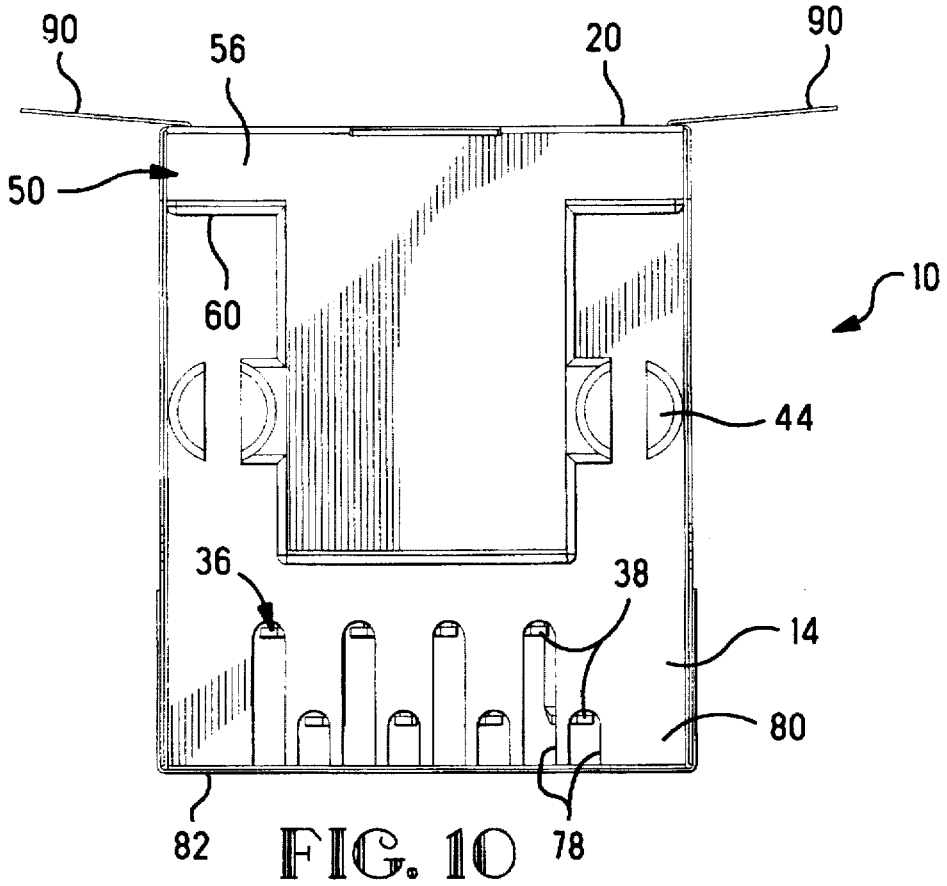

The present invention provides an arrangement by which is minimized the overall height H of the jack 10 above top surface 16 of circuit board 12 (FIGS. 1 and 8). It can be seen in FIGS. 2 and 3 that connector 10 includes structure 50 forwardly of solder tails 38 that extends lower than board-mounting face 14, and that circuit board 12 includes a recess 52 extending inwardly from edge 18 shaped to complement and receive the structure 50 thereinto. Structure 50 forms at least part of the bottom of plug-receiving cavity 30, including a channel 54 along which extends the elongate latch arm of a mating plug connector to extend forwardly of plug-receiving cavity 30.

Thus the shape and dimensions of the plug-receiving cavity are maintained in compliance with accepted industry standards, specifically "FCC Rules for Registration of Telephone Equipment, Part 68, Subpart F, Connectors", in particular, the height of the plug-receiving cavity inclusive of the latch arm recess, required to be between about 9.65 mm and 9.93 mm. To accommodate such cavity height, a conventional modular jack is usually more than 13 mm. However, the top surface of the connector of the present invention is effectively lowered with respect to the top surface of the circuit board, without decreasing the cavity height, to comply with a desire to minimize the height of any connector component above a mezzanine card to no more than 10 mm, as expressed in proposed IEEE P1386/Draft 2.0 of Apr. 4, 1995, "Draft Standard for a Common Mezzanine Card Family: CMC".

Referring now to FIGS. 4 to 7, it is seen that the plug receiving cavity 30 is in communication with the bottom surface of the housing at the center. Mating face 20 of the housing provides spaced apart embossments 56 defining the entrance to the latch arm channel 54, and also providing rearwardly facing surfaces 60 behind which the latch arm of a mating plug connector will latch. Shield 34 includes a bottom wall 62 that traverses the open bottom of housing 32 between mounting legs 44 thereof. Shield 34 also includes a pair of spring arms 64 extending rearwardly from front face 66 to engage the shield of a mating plug connector, being deflectable outwardly into clearance slots 68 along inside surfaces of housing 32. Further, shield 34 preferably includes grounding tabs 90 at the front face 66 extending outwardly and forwardly to be engageable with a conductive panel such as frame 22 for enhanced EMI/RFI protection.

As seen in FIGS. 4 to 7, contacts 36 are insertable into back wall 70 of housing 32 through respective passageways 72 angled inwardly and upwardly, until free ends 74 are received into corresponding grooves 76 in the ceiling of plug receiving cavity 30. Upper portions of solder tails 38 are disposed in respective slots 78 in locating plate 80 to be positioned properly for insertion into through-holes 40 of circuit board 12 (FIG. 2). Such insertion method simplifies automated assembly and also enables the overall length of the contacts to be minimized increasing the speed of signal transmission. For retention, the contacts preferably have retention barbs (not shown) along body sections thereof within passageways 72, as is conventional, and their vertical sections may also be sufficiently wide in grooves 78 to establish a force fit therewithin to best assure precise positioning and alignment with circuit board through holes. Optionally, the contacts may conclude in horizontal solder tails for surface mounting to the circuit board, as is conventional. Shield 34 includes a back wall 82 enclosing and protecting otherwise exposed portions of contacts 36 above locating plate 80 and rearwardly of rear housing wall 70.

The present invention may also be used with connectors other than modular jacks, and may be used with plug style connectors as well, where minimized height is desired. Other variations and modifications may occur that are within the spirit of the invention and the scope of the claims.

What is claimed is:

1. An arrangement of a modular jack and a circuit board, comprising:

a modular jack including at least an insulative housing having board-mounting sections and a plurality of contact members retained therein and having board-connecting sections extending from said housing, and a circuit board having a top surface and an edge and a plurality of conductive sites corresponding to respective said board-connecting sections of said contact members, and further having mounting apertures cooperable with said board-mounting sections of said housing, said board-mounting sections of said housing and said board-connecting sections of said contact members depending below a board-mounting face of said housing abuttable against said top surface of said circuit board;

said modular jack defining a plug-receiving cavity extending inwardly from a mating face, and said contact members including respective contact sections extending into said plug-receiving cavity to be engaged by corresponding contacts of a mating plug connector received into said plug-receiving cavity, and said modular jack further including a bottom section defining at least a latch arm channel adjoining said plug-receiving cavity and extending rearwardly from said mating face at least to rearwardly facing latch surfaces;

said bottom section of said housing extending below said board-mounting face thereof forwardly of said board-connecting sections of said contact members, and said circuit board defining a recess extending inwardly from said edge complementary to said bottom section of said housing, to receive thereinto at least said bottom section of said housing, whereby the height of a top surface of said modular jack above said top surface of said circuit board is minimized.

2. The arrangement as set forth in claim 1 wherein said mounting apertures of said circuit board are in communication with said recess.

3. The arrangement as set forth in claim 1 wherein said modular jack includes a shield surrounding said housing, said shield including a bottom wall traversing an outer surface of said bottom section of said housing and extending rearwardly from a front face of said shield to enclose said plug-receiving cavity.

4. The arrangement as set forth in claim 1 wherein said plug-receiving cavity is in communication with a bottom surface of said bottom section of said housing extending rearwardly from said mating face of said housing.

5. The arrangement as set forth in claim 4 wherein said modular jack includes a shield surrounding said housing, said shield including a bottom wall traversing an outer surface of said bottom section of said housing and extending rearwardly from a front face of said shield to enclose said plug-receiving cavity.

6. An arrangement of a connector and a circuit board, comprising:

a connector including at least an insulative housing having board-mounting sections and a plurality of contact members retained therein and having board-connecting sections extending from said housing, and a circuit board having a top surface and an edge and a plurality of conductive sites corresponding to respective said board-connecting sections of said contact members, and further having mounting apertures cooperable with said board-mounting sections of said housing, said board-mounting sections of said housing and said board-connecting sections of said contact members depending below a board-mounting face of said housing abuttable against said top surface of said circuit board;

said connector defining a mating face, and said contact members including respective contact sections exposed along said mating face to be engaged by corresponding contacts of a mating connector, and said connector further including a bottom section adjoining said mating face;

said bottom section of said housing extending below said board-mounting face thereof forwardly of said board-connecting sections of said contact members, and said circuit board defining a recess extending inwardly from said edge complementary to said bottom section of said housing, to receive thereinto at least said bottoms section of said housing, whereby the height of a top surface of said connector above said top surface of said circuit board is minimized.

* * * * *